US006513175B2

(12) United States Patent
Bertoni

(10) Patent No.: US 6,513,175 B2
(45) Date of Patent: Feb. 4, 2003

(54) BELOW-DECK SOLAR BLANKET ROLLER ASSEMBLY

(76) Inventor: Italo Bertoni, 303 Edinborough St., Windsor, Ontario (CA), N8X 3C3

( * ) Notice: Subject to any disclaimer, the term of this patent is extended or adjusted under 35 U.S.C. 154(b) by 0 days.

(21) Appl. No.: 10/157,858

(22) Filed: May 31, 2002

(65) Prior Publication Data

US 2002/0133871 A1 Sep. 26, 2002

Related U.S. Application Data

(63) Continuation-in-part of application No. 09/848,406, filed on May 4, 2001, now Pat. No. 6,421,845.

(30) Foreign Application Priority Data

Nov. 16, 2000 (CA) ..... 2326018
Nov. 27, 2001 (CA) ..... 2364137

(51) Int. Cl.[7] ..... E04H 4/10
(52) U.S. Cl. ..... 4/502; 126/624
(58) Field of Search ..... 4/498, 500, 502; 49/49, 372, 373; 126/624, 626

(56) References Cited

U.S. PATENT DOCUMENTS

RE25,078 E * 11/1961 McGuire ..... 4/502
3,076,975 A 2/1963 Lamb
3,087,167 A 4/1963 Cowan
3,916,457 A 11/1975 Morita
4,220,880 A * 9/1980 Woodard
5,913,613 A 6/1999 Ragsdale et al.
5,927,042 A * 7/1999 Last ..... 4/502
6,324,706 B1 * 12/2001 Epple ..... 4/502

FOREIGN PATENT DOCUMENTS

DE 28 03 517 A 8/1979
DE 29 38 496 A 4/1980
DE 3 026 956 2/1982
FR 2 745 842 A1 3/1996
WO PCT/FR93/01016 10/1993

* cited by examiner

*Primary Examiner*—Charles R. Eloshway

(57) ABSTRACT

A below-deck solar blanket roller assembly is installed below the deck of a pool. The roller assembly includes a rotatable roller shaft for rolling and unrolling a solar blanket and a non-rotatable protective casing which surrounds the roller shaft. The roller assembly is intended to be installed below the deck of a pool. This invention at least partially overcomes some of the disadvantages of typical solar blanket rollers that are installed on the surface of the pool deck, such as inconvenience in moving the entire above-deck assembly away from and back to the pool area. The below-deck solar blanket roller assembly provides an aesthetically pleasing and safe alternative to solar blanket roller assemblies installed above the pool deck.

20 Claims, 11 Drawing Sheets

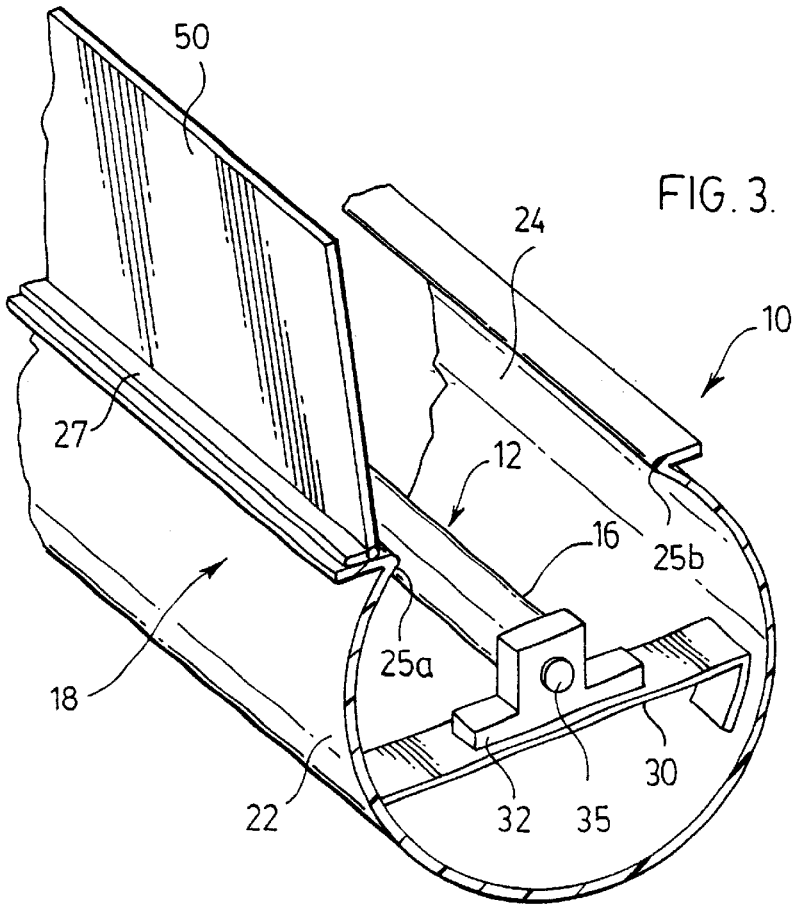
FIG. 3.
FIG. 4.
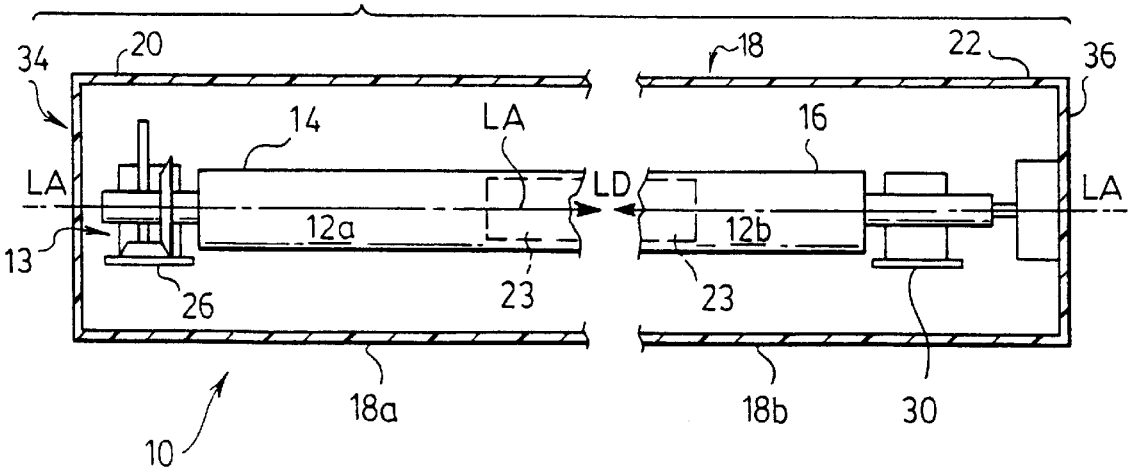

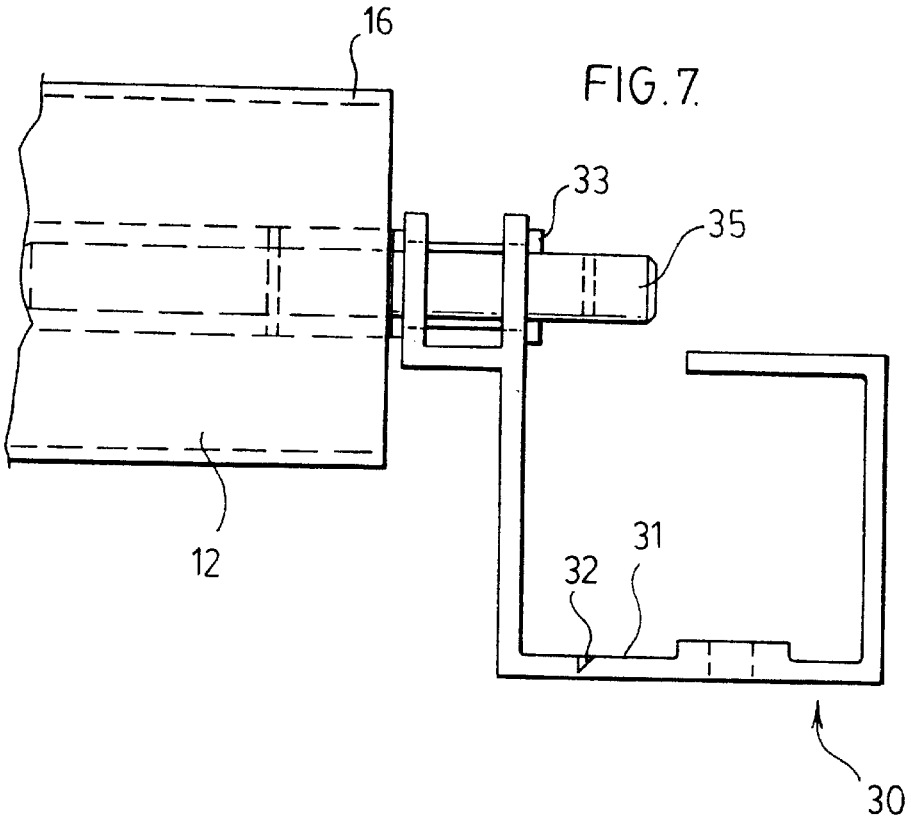
FIG. 7.
FIG. 8.
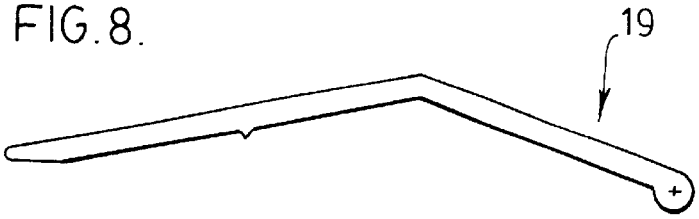
FIG. 9.
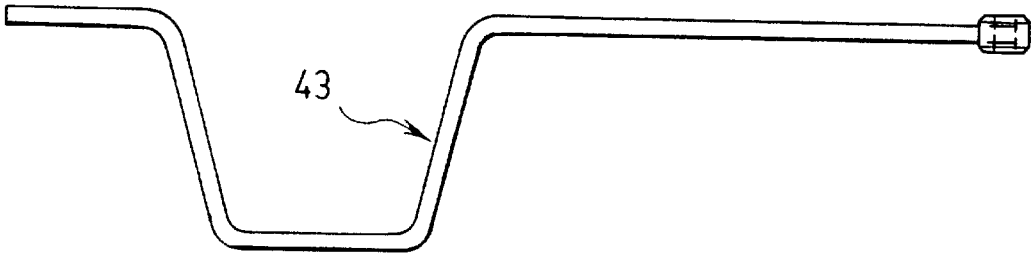

BELOW-DECK SOLAR BLANKET ROLLER ASSEMBLY

RELATED APPLICATIONS

This application is a continuation-in-part of U.S. patent application Ser. No. 09/848,406, filed May 4, 2001 now U.S. Pat. No. 6,421,845.

FIELD OF THE INVENTION

This invention relates to a solar blanket roller assembly and, in particular, a solar blanket roller assembly which is intended to be installed and stored below the surface of the surrounding deck of a pool.

BACKGROUND OF THE INVENTION

In the past, solar blankets have been used to cover swimming pools in order to reduce the amount of heat lost from the pool. Typically, the solar blanket consists of a floating plastic or foam mat which is cut to a size and shape generally corresponding to the surface of the pool. The solar blanket is stretched over the surface of the pool during periods when the pool is not in use. When the pool is intended to be used, the solar blanket is often stored on a roller assembly which consists of an elongated roller shaft which mounts a wheel at each of its ends, with one end of the blanket physically coupled to the shaft by a series of flexible straps. Typically, the solar blanket is removed from the pool surface by winding it for storage about the elongated roller shaft. The wheels provided at each end of the roller shaft enable the shaft, together with the solar blanket stored thereon, to roll along the top of the pool deck. Once the solar blanket has been removed from the pool surface, the entire roller assembly is moved via the wheels away from the pool area for storage. To return the solar blanket back onto the surface of the pool, the entire roller assembly is again rolled back into a position adjacent to the pool surface, and the solar blanket is unrolled from the roller shaft and onto the surface of the pool.

Because the roller assembly rests directly on the top of the pool deck, it is an inconvenience to move the entire roller assembly away from and back to the pool area. Furthermore, the roller assembly may disadvantageously hinder movement about the pool and could present an obstruction which could otherwise injure a pool user.

In addition, the placement of conventional roller assemblies on top of the deck takes up room that could otherwise be used for other activities, and also may be aesthetically unpleasing either when the solar blanket is rolled up for storage or when it is deployed over the pool surface.

In colder climates conventional solar blanket storage assemblies present a further disadvantage in that given their size, they are often difficult to store during the winter months. Often the roller shaft may be fifteen feet or more in length, necessitating that the solar blanket be either stored outside with the roller assembly, or detached therefrom and stored elsewhere.

SUMMARY OF THE INVENTION

Accordingly, it is an object of this invention to at least partially overcome the disadvantages of the prior art. Thus, it is an object of this invention to provide an improved type of solar blanket roller assembly which is installed below the grade or deck of a pool.

Another object of the invention is to provide a roller assembly for a solar blanket which permits simplified deployment and storage of the solar blanket over the surface of an in-ground pool.

A further aspect of the invention is to provide a solar blanket assembly which enables a solar blanket to be stored immediately adjacent to the edge of a pool without otherwise obstructing or hindering movement about the pool deck area.

Another object of the invention is to provide a method by which a roller assembly for a swimming pool solar blanket may be installed easily and quickly in a position substantially below the grade of the surface or deck surrounding the pool.

The present invention includes a solar blanket and roller assembly for use with an in ground swimming pool. The roller assembly comprises a longitudinally elongated housing which, most preferably, has a length selected at least one to two feet longer than the lateral width of the pool. The housing defines an elongated interior cavity having a dimension selected to enable the storage of the solar blanket in a rolled configuration therein. A rotatable roller shaft or spindle is provided within the housing. The spindle has a length corresponding to or greater than the width of the blanket and is configured to be manually electrically, pneumatically and/or hydraulically journalled in rotation. Thus the solar blanket may be coupled to the spindle and wound into the housing by selectively rotating the spindle.

An elongated opening extends substantially the longitudinal length of the housing and allows the solar blanket to be drawn from or wound into the housing for deployment or storage. Optionally, a lid or cover may be provided which may be opened or closed to permit or prevent access into the housing interior.

In use, the housing is recessed into the ground and positioned with its elongated opening oriented upward so that the housing opening is generally flush with the grade or deck surface immediately surrounding the pool.

Accordingly, in one aspect, this invention resides in a below-deck solar blanket roller assembly comprising: a rotatable roller shaft for rolling and unrolling a solar blanket, the shaft having first and second ends and a longitudinal axis extending in a longitudinal direction; a non-rotatable protective housing or casing having first and second ends, wherein the housing is spaced radially from the roller shaft, surrounds the roller shaft, and extends in the longitudinal direction, and wherein the housing has an elongated opening extending in the longitudinal direction; first end support supporting the first shaft end and positioning the first shaft end inside and relative to the housing; second end shaft support supporting the second shaft end and positioning the second shaft end inside and relative to the housing; first end wall closing the first end of the casing; second end wall closing the second end of the housing; a drive coupler engaging a portion of the roller shaft for receiving rotational energy from a source to rotate the roller shaft.

In another aspect the present invention resides in a below-deck solar blanket roller assembly comprising:

- a rotatable roller shaft for rolling and unrolling a solar blanket, the shaft having first and second ends and a longitudinal axis extending in a longitudinal direction;
- a non-rotatable protective casing having first and second ends and extending in the longitudinal direction, the casing has a diameter selected such that the casing is spaced radially from the roller shaft, and wherein the casing has a knock-out portion removable to form an elongated opening extending in the longitudinal direction;

a first end support for supporting the first shaft end and positioning the first shaft end inside and relative to the casing;

a second end shaft support for supporting the second shaft end and positioning the second shaft end inside and relative to the casing;

a power coupler at an end of the roller shaft for receiving power from a source to rotate the roller shaft.

In a further aspect the present invention resides in a solar blanket roller assembly for installation substantially below the deck of a pool, comprising:

a rotatable roller shaft for rolling and unrolling a solar blanket, the shaft having first and second ends and a longitudinal axis extending in a longitudinal direction;

a non-rotatable protective casing having first and second ends, the casing being elongated in the longitudinal direction and being spaced radially from said roller shaft, said casing further comprising, at least one extruded segment being elongated along an axis having a longitudinally extending knock-out portion in an upper region thereof which is removable to form part of an elongated opening, and a first end support for supporting and positioning the first shaft end inside the casing, a second end support for supporting and positioning said second shaft end inside the casing, and a drive spaced towards one end of said roller shaft and being selectively operable to rotate said roller shaft.

In yet another aspect the present invention resides in a method of installing a below-deck solar blanket roller assembly for a swimming pool, the roller assembly comprising, a roller shaft for rolling and unrolling a solar blanket thereon, said roller shaft extending along a longitudinal axis from a first end to a second end, a non-rotatable protective casing having first and second end portions, the casing being elongated in the longitudinal direction and being spaced radially from said roller shaft, said casing further comprising, a first extruded segment and a second extruded segment, each of said first and second segments having a longitudinally extending knock-out portion in an upper region thereof which is removable to form part of an elongated opening, a first end support for supporting and positioning the first shaft end inside the casing, a second end support for supporting and positioning said second shaft end inside the casing, and a drive spaced towards one end of said roller shaft and being selectively operable to rotate said roller shaft, the roller assembly being installed by, coupling said first extruded segment to said second extruded segment with the knock-out portion of said first segment substantially aligned with said knock-out portion of said second segment, positioning said casing in a trench adjacent the pool with the knock-out portions oriented upwardly and substantially flush with a surface of the deck, backfilling about the casing, and removing said knock-out portions to form an elongated opening.

More preferably, the casing further includes a lid, and said method further comprises, hingely coupling said lid at a position adjacent to said first segment knock-out portion and said second segment knock-out portion, so as to be pivotally movable between first and second positions to substantially close or open said elongated opening; and wherein the step of backfilling about said casing comprises pouring a settable concrete about said casing, and following backfilling about the casing, the hinge is moved from said first position to the second position.

Further aspects of the invention will become apparent upon reading the following detailed description and drawings which illustrate the invention and preferred embodiments of the invention.

BRIEF DESCRIPTION OF THE DRAWINGS

In the drawings, which illustrate embodiments of the invention:

FIG. 3 is a partial perspective end view of a first idler end of the solar blanket roller assembly shown in FIG. 1 with the solar blanket removed for clarity;

FIG. 4 is a partial schematic front view of a solar blanket roller assembly of FIG. 1 with the solar blanket removed for clarity;

FIG. 7 illustrates an enlarged partial schematic end view of the idler end assembly used in the roller assembly of FIG. 1;

FIG. 8 illustrates an enlarged end view of the retaining clamp used in coupling the solar blanket to the roller assembly spindle;

FIG. 9 illustrates a perspective view of the hand crank used in the operation of the roller assembly;

DETAILED DESCRIPTION OF THE PREFERRED EMBODIMENTS

Figure 1:
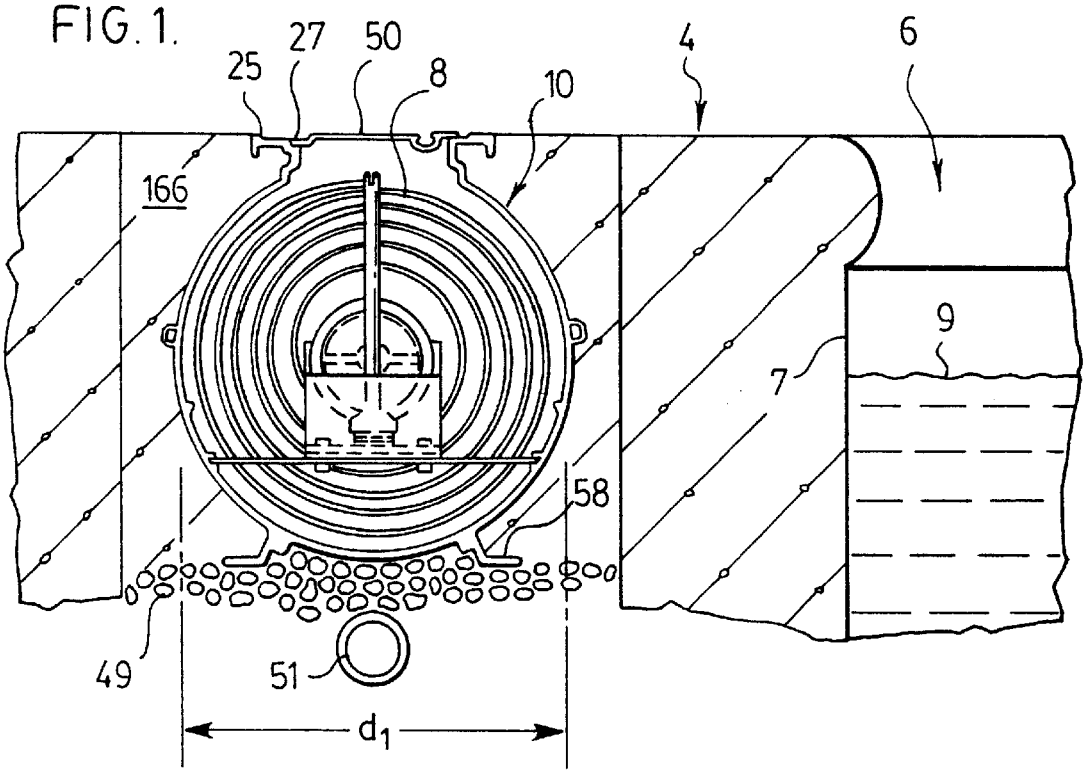
FIG. 1 shows a partial cross-sectional end view of a first embodiment of a solar blanket roller assembly installed recessed flush with a swimming pool deck, and with a solar blanket housed therein in a storage position.

FIG. 1 illustrates a cross-sectional view of the portion of a concrete patio or deck 4 which borders and most typically surrounds an in-ground swimming pool 6. As will be described hereafter, a roller assembly 10 for use in storing and deploying a solar blanket 8 is recessed into the deck 4 adjacent to the end 7 of the pool 6. Although final positioning may vary, most preferably the solar blanket roller assembly 10 is positioned so that its uppermost surface is substantially flush with the surface of the deck 4, and approximately 0.5 to 3 feet from the pool end 7. When rolled for storage, the solar blanket 8 is thus stored in a position recessed below the surface of the deck 4 so as not to present a tripping hazard, or otherwise create an aesthetically unsightly appearance.

The solar blanket 8 may be of a conventional design, typically consisting of a flexible plastic membrane which has a series of discreet air pockets integrally formed therein to provide the blanket 8 with sufficient buoyancy to enable it to be floated on the water surface 9 of the swimming pool 6. The roller assembly 10 is configured to enable the solar blanket 8 to be coiled for storage therein so that the blanket 8 is contained entirely within the solar blanket roller assembly 10 beneath the surface of the deck 4.

Figure 2:
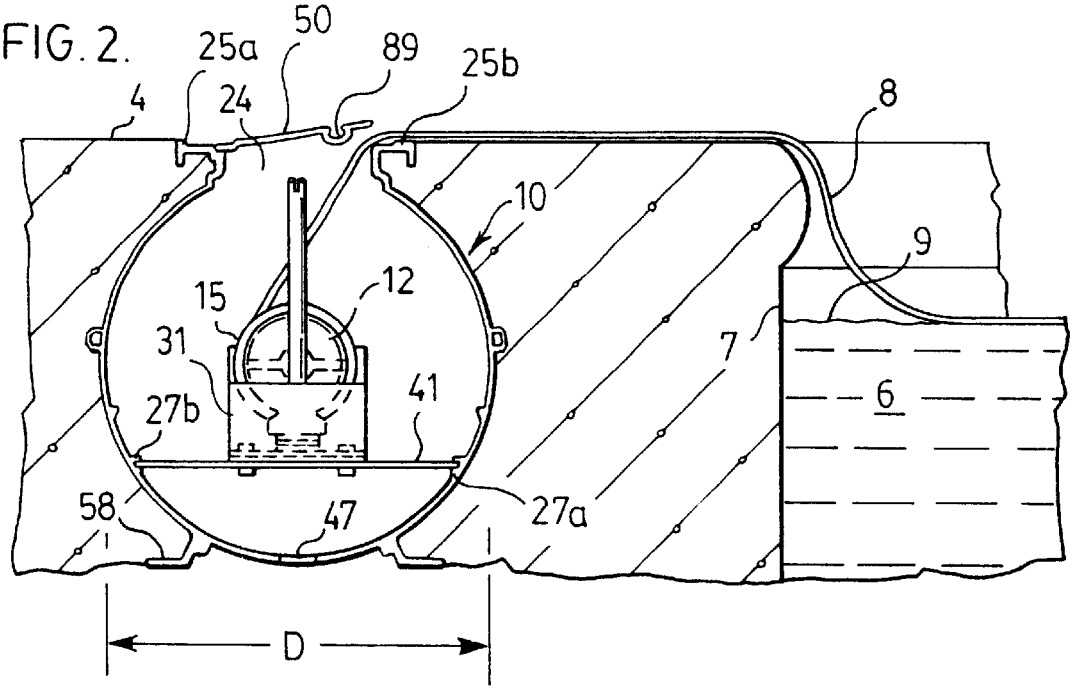
FIG. 2 shows the cross-sectional view of FIG. 1 with the solar blanket deployed from within the roller assembly and overlying the surface of the pool.

As is shown in FIG. 2, the solar blanket roller assembly 10 enables the solar blanket 8 to be selectively unwound from the coiled storage position shown in FIG. 1, and stretched across the water surface 9 when the pool 6 is not in use.

FIGS. 2 and 4 show best the construction of the roller assembly 10. Preferably, the entire solar blanket roller assembly 10 extends in a longitudinal direction LD one to two feet past each edge of the pool end 7, and in the case of a typical residential pool installation will have a length of between about 14 and 26 feet, so as to permit the solar blanket 8 to be housed therein. The roller assembly 10 includes an elongated cylindrical roller spindle or shaft 12, an elongated generally cylindrical casing or housing 18 and a spindle drive assembly 13. The shaft 12 is rotatably mounted at each of its ends at 14, 16 (shown best in FIGS. 5 and 7) within the elongated generally cylindrical housing 18. The roller shaft 12 or spindle is formed from a number of hollow extruded aluminum spindle segments 12*a*, 12*b* (FIG. 4) which are each typically about 6 to 12 feet in length. The shaft segments 12*a*, 12*b* are joined to each other by inserting a cylindrical connector segment 23 into the adjacent open ends of each shaft segment 12*a*, 12*b*, and thereafter inserting screws (not shown) to couple each segment 12*a*, 12*b* to the connector 23. Once the spindle segments 12*a*, 12*b* are assembled, the completed roller shaft 12 extends in the longitudinal direction LD from its first end 14 to the second end 16 along longitudinal axis $L_A$ (FIG. 4). It is to be appreciated that although the tubular spindle segments 12*a*, 12*b* most preferably have a length selected at between about 6 and 12 feet for shipping convenience, the number of tube segments 12*a*, 12*b* and final length of the shaft 12 will ultimately depend upon the width of the solar blanket 8 which is to be installed.

A rearward most edge 15 (FIG. 2) of the solar blanket 8 is attached directly to the spindle 12. The blanket 8 may be attached to the spindle 12 by suitable means including rivets, screws, glues, touch fasteners or ties.

Most preferably, however, the edge 15 of the blanket 8 is secured to the shaft 12 in a clamp-fit arrangement by means of an elongated aluminum retaining bar 19 (FIG. 8) which is coupled to the spindle 12 by screws 21. As will be described, in use of the roller assembly 10, the solar blanket 8 is coiled about the spindle 12 through its selective rotation by the drive assembly 13.

As shown best in FIGS. 2 and 4, the housing 18 has a generally cylindrical profile and extends in the longitudinal direction LD (FIG. 4), a marginal distance past each spindle end 14, 16. In a preferred embodiment, the housing 18 formed from a series of extruded metal, PVC or other plastic segments or sections 18*a*, 18*b* (see FIG. 4) which are joined in axial alignment. In the cross-section shown in FIG. 2, the housing 18 is illustrated having radial diameter D which is marginally greater than the maximum diameter $d_1$ (see FIG. 1) of the solar blanket 8 when rolled for storage about the spindle 12. With roller assemblies for use with most residential pools, the housing 18 will have a radial diameter of between about 1 and 2 feet, and more preferably about 15 inches. As a result, the housing 18 is spaced radially about and generally surrounds the roller shaft 12.

An elongated opening 24 is provided through the uppermost extent of the housing 18. The opening 24 extends in the longitudinal direction LD a distance at least as wide as the lateral width of the blanket 8. The opening 24 is sized to enable the blanket to be unwound from the coiled position about the roller shaft 12 and stretched across the water surface 9 as for example is shown in FIG. 2. Preferably, the opening 24 has a width of between about 3 and 8 inches and more preferably approximately 5.5 inches.

The edge portions of the housing extrusion which define the longitudinal sides of the opening 24 extend away from each other as a pair of outwardly extending flanges 25*a*, 25*b*. In addition to defining an uppermost surface of the housing 18, the flanges 25*a*, 25*b* provide a lip under which concrete is backfilled to assist in anchoring the housing 18 in the desired position recessed into the pool deck 4 (FIG. 2).

FIG. 4 shows best each longitudinal end 20, 22 of the housing 18 being sealingly closed by an end cover 34,36. It is to be appreciated that the end covers 34, 36 have a profile selected to correspond to the interior cross-sectional profile of each extruded housing section 18*a*, 18*b*. The end covers 34, 36 may be formed of PVC or other plastics and/or metals and secured in place by an appropriate plastic cement, or by mechanical fasteners such as screws or the like.

Figure 14:
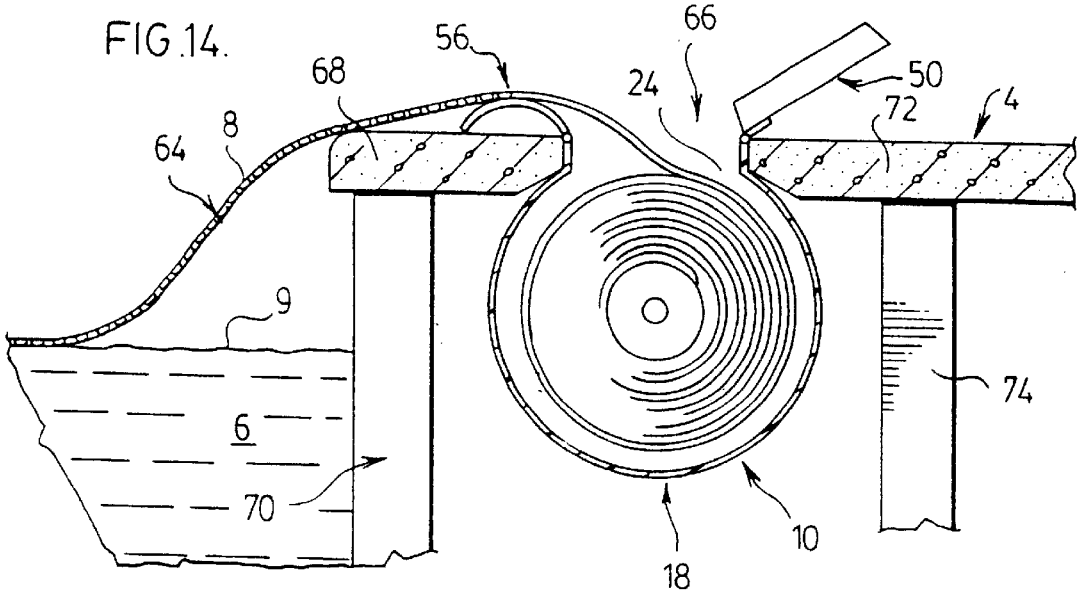
FIG. 14 is a partial cross-sectional view showing one way in which the roller assembly of FIG. 12 may be installed.

As shown best in FIGS. 1 and 2, an extruded aluminium cover or lid 50 is provided over the opening 24. The lid 50 is connected to the edge of the opening 24 which is furthest from the pool 6 by one or more piano hinges 27. Although not essential, for ease of shipment, the lid 50 preferably is also formed from a series of extruded aluminium segments each having a length of between about 7 and 12 feet and which are connected by a series of splines. The lid 50 covers the elongated opening 24 in the housing 18. The lid 50 is movable relative to the hinge 27 from a first position (as shown in FIG. 1) where the elongated opening 24 in the housing 18 is closed to a second position where the lid 50 is moved to an orientation extending radially outward of the housing 18 where the elongated opening 24 in the housing 18 is open (as shown in FIG. 14) to permit access into the interior of the housing. As shown in FIG. 1, the lid 50 and the piano hinges 27 have a profile selected so that when closed, the lid 50 lies substantially flush with both the flanges 25*a*, 25*b* and the surface of the deck 4 when the solar blanket 8 is coiled about the spindle 12 in a storage configuration.

The roller spindle 12 is rotatably supported within the housing 18 by means of a pair of spindle end supports 26, 30. The first end supports 26 the first shaft end 14 and also positions the first shaft end 14 inside the housing 18 in approximately coaxial alignment therewith. Preferably the first end support 26 supports the first end 14 through a bearing assembly 28 or other suitable device to permit easy rotation of the roller shaft 12. Similarly, the second end shaft support 30 supports the second shaft end 16 and which positions the second shaft end 16 inside the housing 18 in coaxial alignment therewith. Once again, a bearing assembly 32 or other suitable device is provided to permit easy rotation of the roller shaft 12 about the axis LA.

Figure 5:
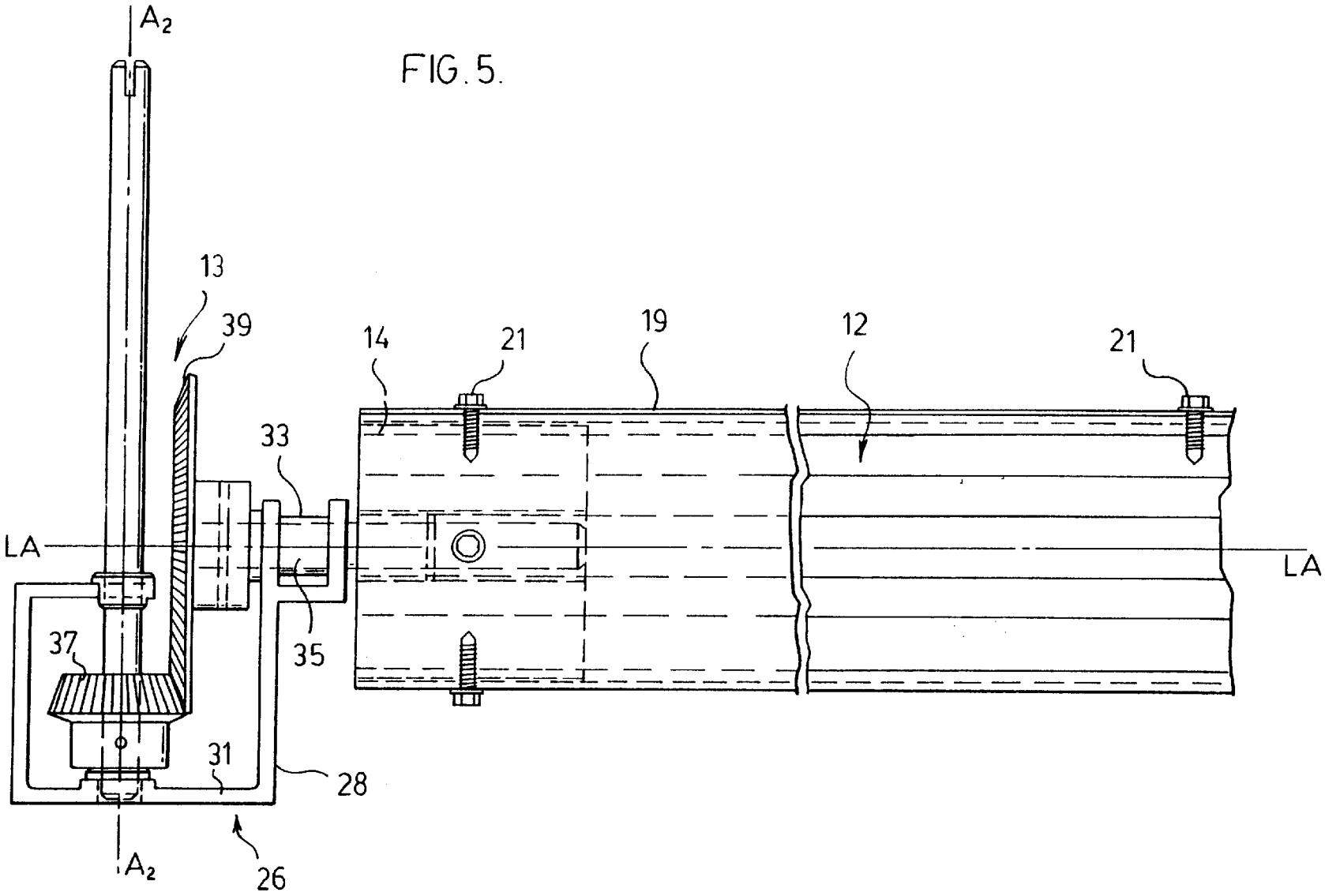
FIG. 5 illustrates an enlarged partial schematic end view of the second other drive end assembly used in the roller assembly of FIG. 1.
Figure 6:
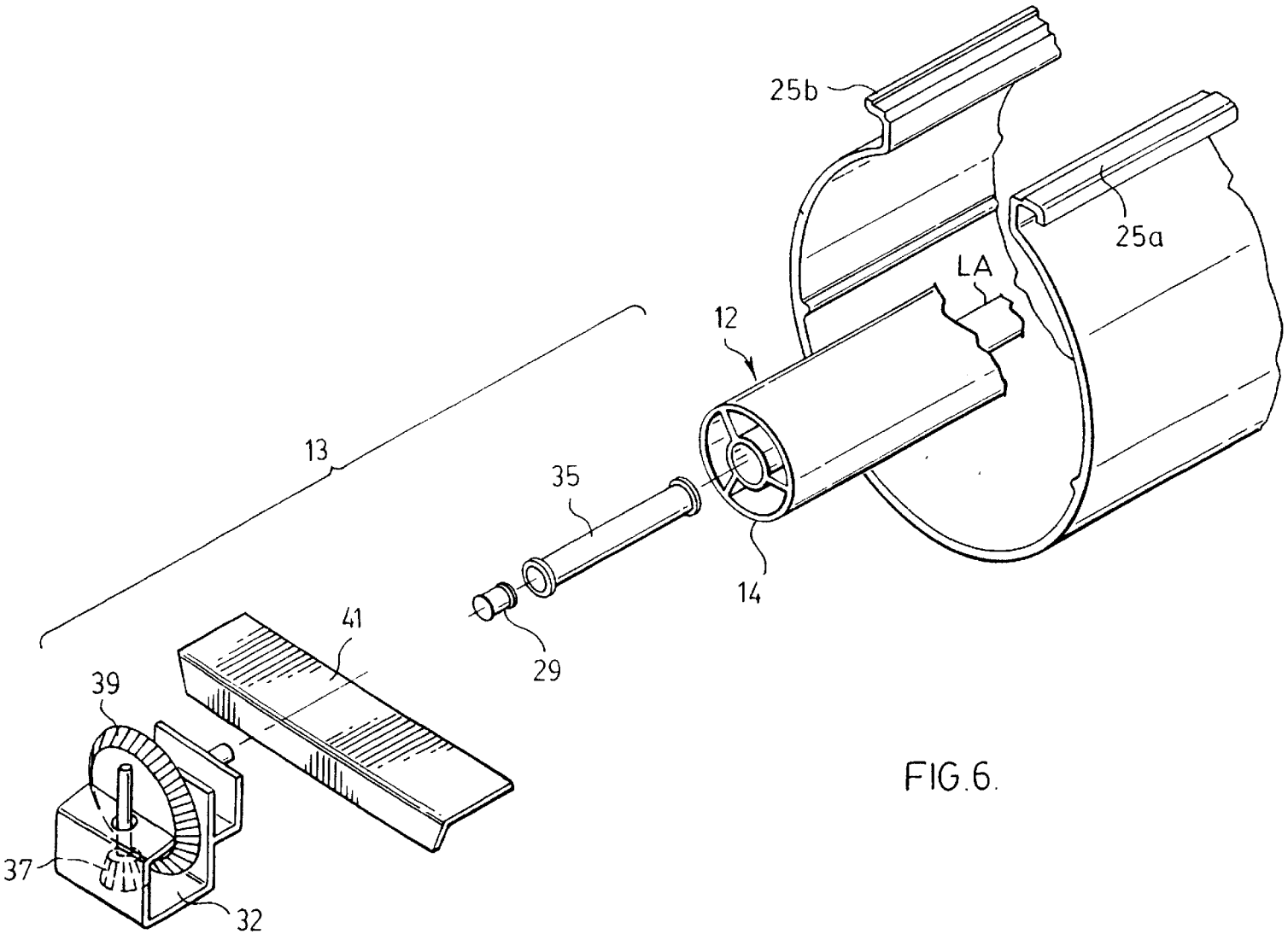
FIG. 6 illustrates a schematic exploded view of the drive assembly of FIG. 5.
Figure 18:
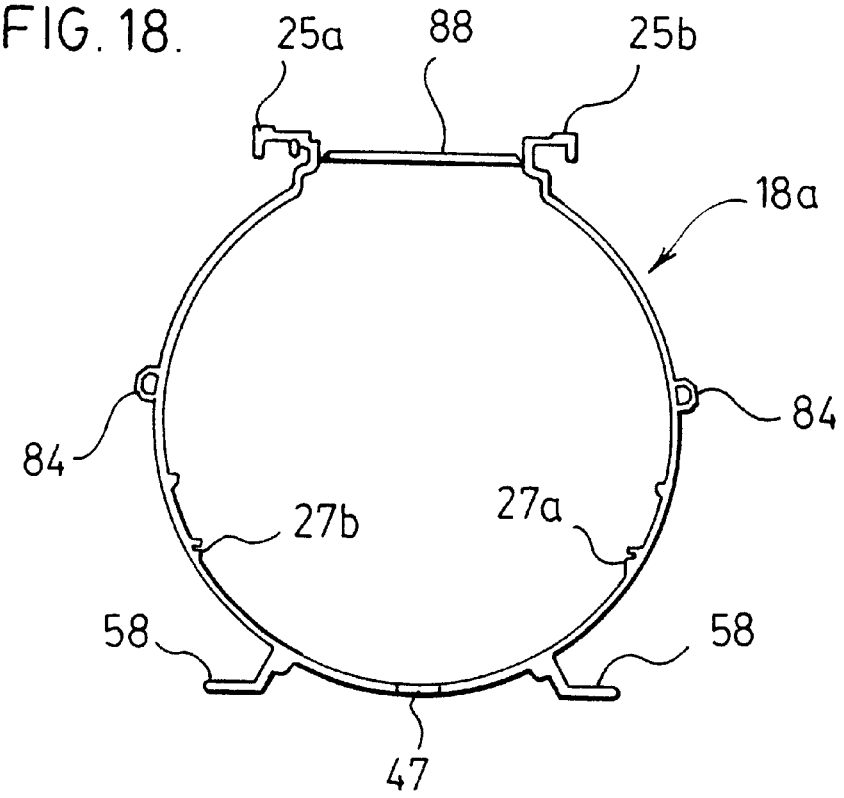
FIG. 18 is a cross-sectional end view of the housing section shown in FIG. 17 taken along line 18–18'.

In a simplified construction, as shown in FIGS. 5 and 7, the bearing assemblies 28, 32 each consist of a galvanized steel L bracket 31 which in assembly, are mounted to a plate 41 (FIG. 2) supported by a pair of flanges 27*a*, 27*b* (FIG. 18) which are integrally formed with the housing extrusion. Each of the bearing assemblies 28, 32 further include a respective bushing 29, 33 which rotatably supports a stainless steel pivot shaft 35 positioned so as to project axially from each end 14, 16 of the spindle 12. As is shown best in FIG. 2, in the preferred embodiment of the invention, the plate 41 used in the first end support 26 comprises a rigid piece of galvanized metal extending from first extended flange 27*a* formed on the inner peripheral wall of the housing 18 to the second flange 27*b* on the inner peripheral wall of the housing 18 which is opposite thereto. Similarly, the plate 41 used in the second end support 30 is comprised of a similar rigid piece of galvanized metal extending from the flange 27*a* at a longitudinally displaced position on the inner peripheral wall of the housing 18 to an opposing position on the flange 27*b*. It is to be appreciated that the housing 18 extrusion may alternately include an axially extending extruded boss, groove, ridge or the like to assist in locating and retaining the plate 41 within the housing 18.

Preferably, the rigid plates 41 of each support 26, 30 are aligned in a plane parallel to a plane defined by the longitudinal axis LA and an axis orthogonal to the longitudinal axis. In a more preferred embodiment of the invention, in the final assembly of the roller assembly 10 each of the plates 41 is provided in a generally horizontal arrangement, as for example is shown in FIG. 2.

FIG. 5 illustrates best the drive assembly 13 as including a nylon horizontal bevel gear 37, a second nylon bevel gear 39 and drive shaft 40. The horizontal bevel gear 37 is rotatably mounted to the bracket 31 of the bearing assembly 28 for rotation about a vertical axis $A_2$—$A_2$. The second bevel gear 39 is fixedly mounted to the pivot shaft 35 which projects from the spindle end 14 in meshing engagement with the gear 37. The drive shaft is coupled to the horizontal bevel gear 37 in alignment with the vertical axis $A_2$—$A_2$ whereby the rotation of the shaft 40 about the axis $A_2$—$A_2$ rotates the gears and turns the spindle 12 about the axis LA. As shown best in FIG. 9, a hand crank 43 is provided to permit the manual rotation of the drive shaft 40. The hand crank 43 has at its lowermost end a socket 45 for use in engaging the uppermost end of the shaft 40. More preferably, the tooth spacing of the bevel gears 37, 39 is selected to rotate the spindle 12 360° with every 2 to 3 turns of the crank 43.

To permit the drainage of any water which may enter into the housing 18 as the solar blanket 8 is coiled for storage, a series of drain holes 47 (FIG. 2) are formed at spaced locations along the bottom of the housing 18. It is to be appreciated that the drain holes 47 allow any pool water which is carried into the housing 18 with the solar blanket 8 to flow outwardly from the housing interior and into a weeping bed of crushed gravel 39 and tile 41 (FIG. 1). The sealing of the housing ends 20, 22 and drain holes 47 are preferred in order to keep as much dirt and other debris as possible from entering the housing 18 after the housing 18 has been installed, and thereafter to permit the periodic cleaning of the roller assembly 10.

With the roller assembly 10 configuration of FIGS. 1 to 9 to move the solar blanket 8 to a storage position coiled about the spindle 12 and contained within the housing 18, a user would open the lid 50 and fit the socket 45 of hand crank 43 over the drive shaft 40. With the hand crank 43 so positioned, the crank 43 would be turned in a horizontal plain to rotate the bevel gears 37, 39 and spindle 12. As the spindle 12 turns, the solar blanket 8 is pulled from the pool surface 9 into the housing 18 coiling about the spindle 12 to the storage position shown in FIG. 1. Once the solar blanket 8 is coiled in the housing 18, the lid 50 is thereafter closed, clearing the surface of the deck 4 from any obstructions or tripping hazards. It is to be appreciated that in deploying the solar blanket 8, the lid 50 is simply reopened, and the user grasps and pulls the free edge of the solar blanket 8 unrolling it off the spindle 12 and across pool 6.

Figure 10:
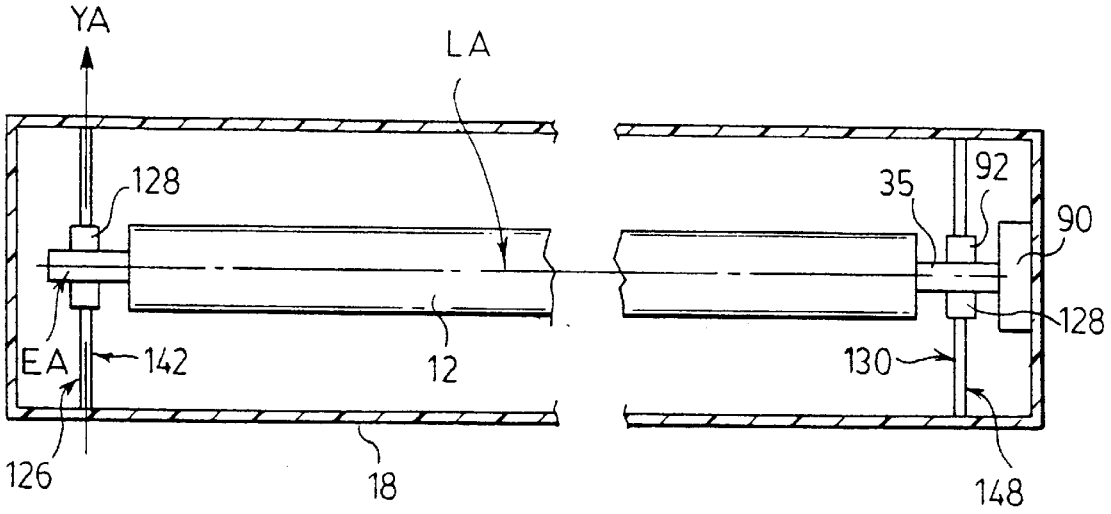
FIG. 10 is a partial schematic view of a roller assembly in accordance with a second embodiment of the invention.

Although FIGS. 1 to 9 describe the roller assembly 10 as being operated by means of a hand crank 43, the invention is not so limited. Other power sources used to return the blanket 8 to a rolled position may also be used. By way of on-limiting example, an alternate embodiment of the invention is shown in FIG. 10. In FIG. 10, the power source could be a suitable electric motor, such as a low voltage electrical motor 90. The electric motor 90 could be positioned within the housing 18 or outside the housing 18. In either case, there would be suitable power linkage 92 from the electric motor 90 used to translate rotational power to the pivot shaft 35.

The power linkage 92 may be any suitable power coupler, including something as simple as a hole in the end of the roller shaft 12 to receive a similarly-shaped insert from the output shaft of the motor 90. Also, the power linkage 92 could further include a sprocket, gear, or longitudinal extender.

In an alternative embodiment shown in FIG. 10, the roller shaft 12 and the housing 18 are substantially the same as discussed above and shown in FIGS. 1 and 9 with the exception of the supports used to rotatably mount the first end support 126 as shown in FIG. 10 is comprised of a support member 142 which is aligned in a plane defined by two axes which are orthogonal to each other and also orthogonal to the longitudinal axis LA. For example, as shown in FIG. 10, the two axes which are orthogonal to each other are the vertical axis YA and the Z axis ZA which comes transversely out of the paper of FIG. 10. In this embodiment, the second end support 130 similarly comprises a rigid support member 148 which is aligned in a plane defined by two axes which are orthogonal to each other and also orthogonal to the longitudinal axis. Also, in order to have roller shaft 12 rotate most easily, each of the support members 142, 148 upport bearing assemblies 128.

Figure 11:
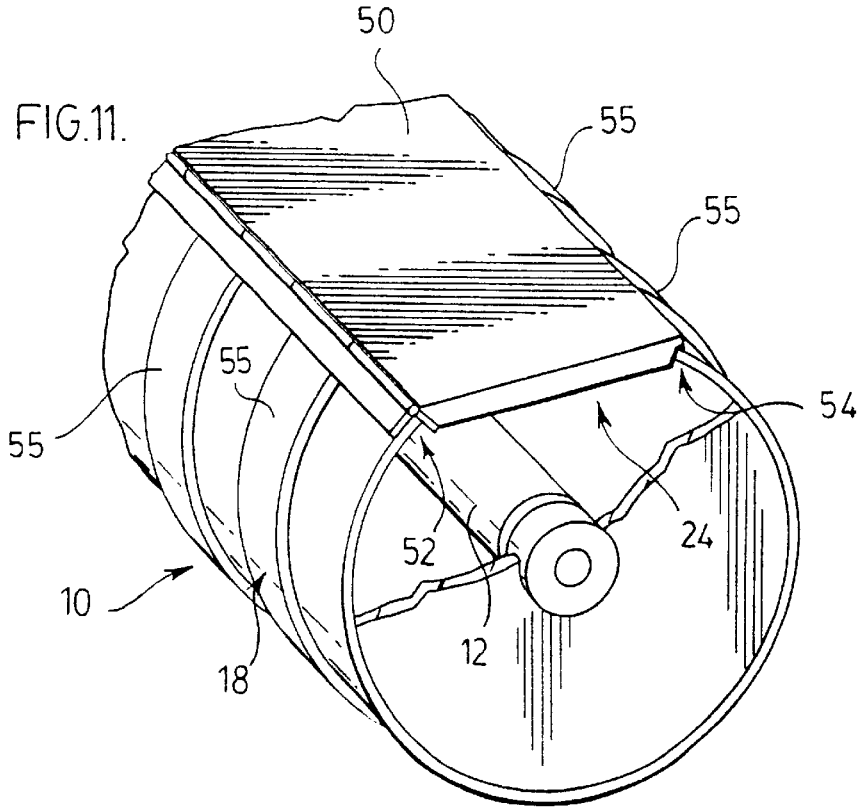
FIG. 11 is a partial perspective cut-away view of a solar blanket roller assembly housing in accordance with another embodiment of the invention with the solar blanket removed for clarity.

As may be seen in FIG. 11, in still a further embodiment of the invention, the housing 18 may further include a number or longitudinally spaced reinforcing ribs 55. The reinforcing ribs 55 provide the housing 18 with increased rigidity and assist in anchoring the housing 18 against movement. In FIG. 11, the opening 24 in the housing 18 is defined by first edge 52 and second edge 54 in place of flanges 25*a*, 25*b*. As may be seen in FIG. 12, the lid 50 may be hinged to the housing 18 in the area adjacent to the first edge 52.

Figure 12:
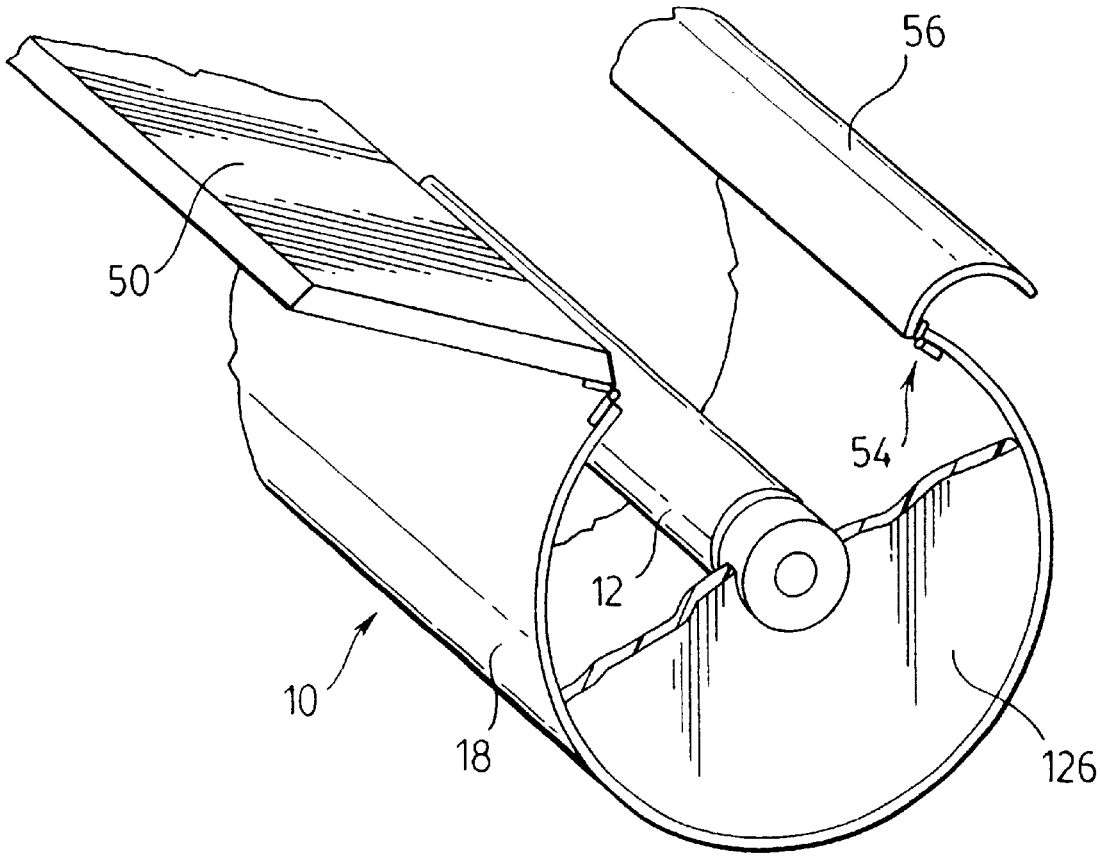
FIG. 12 is a partial perspective cut-away view of a solar blanket roller assembly in accordance with another embodiment of the invention, with the solar blanket removed for clarity.

Optionally, a blanket protector 56 may be hinged to the housing 18 in an area adjacent to the second edge 54. The blanket protector 56 rotatably moves from a first position located substantially within the housing 18 to a second position radially outward from the housing 18 as shown in FIG. 12 during the deployment or storage of the blanket 8.

As is shown in FIG. 14, blanket protector 56 protects the solar blanket 8 as the solar blanket 8 is either unwound from the roller shaft 12 or wound back up onto the roller shaft 12. In particular, in use, the lid 50 and protector 56 are both moved to their respective open position shown in FIG. 14 when the operator desires to either unroll the solar blanket 8 from the roller shaft 12 and place the solar blanket over the surface of the pool 6 or, alternatively, when an operator wants to roll the solar blanket 8 back onto the roller shaft 12. When the solar blanket 8 is either entirely rolled onto the roller shaft 12 or when the solar blanket 8 is positioned over the pool surface, the operator will typically close the lid 50 so as to cover the elongated opening 24, primarily for safety reasons but also for aesthetic reasons.

Although not essential, the lid 50 may also have a "V" shape cross-section so that it wedges into the opening 24 and is at least partially supported by the first and second edges 52 and 54 of the opening 24. Alternatively, the lid 50 could be partially supported by the flanges 25*a*, 25*b* (as shown in FIG. 2).

Figure 13:
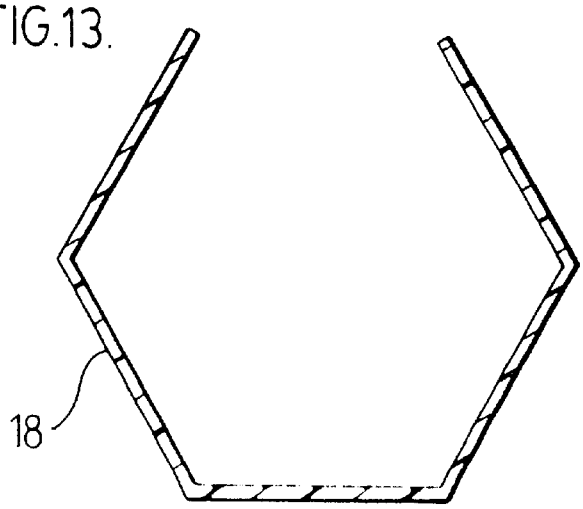
FIG. 13 is a cross-sectional end view of a solar blanket roller assembly housing in accordance with a further embodiment of the invention.

In a preferred embodiment, the housing 18 is formed from PVC plastic, primarily to provide strength and rigidity to the housing 18. Alternatively, in another embodiment, the housing 18 could be formed from an aluminium or other plastic extrusion, as well as galvanized steel or other corrosive-resistant metal. In this embodiment, the casing need not be circular in cross-section. For example, the housing 18 could have a generally square or hexagonal lateral cross-sectional shape as shown in FIG. 13, or some other suitable cross-sectional shape.

In a pool 6 that is at least partially surrounded by a deck 4, the roller assembly 10 is intended to be installed substantially below the deck surface 4. The housing 18 is oriented such that the opening 24 in the housing 18 is either substantially flush with the deck surface 4 or is otherwise aligned with an opening 66 (FIG. 14) in the deck 4. In one embodiment, the opening 66 in the deck 62 is spaced away from a portion of the deck 68 which is immediately adjacent to the pool 64. Preferably the portion of the deck 68 immediately adjacent to the pool 64 is supported by the pool wall 70. In a more preferred embodiment of the invention, the opening 66 in the deck is spaced between the portion of the deck 68 immediately adjacent to the pool 64 and a deck portion 72 distant from the pool 64. In one possible construction, the deck portion 72 distant from the pool 64 is supported by a deck support 74.

Figure 15:
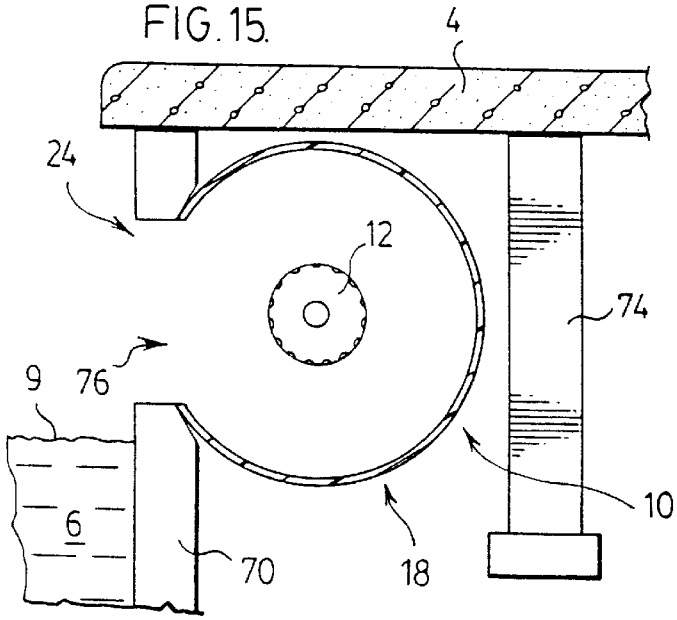
FIG. 15 is a partial cross-sectional view showing another way in which the solar blanket roller assembly of the present invention may be installed.

In another embodiment of the invention shown in FIG. 15, the housing 18 is oriented such that the opening 24 in the housing 18 is aligned with an opening 76 in the pool wall 70.

In FIG. 1, the housing 18 is shown as being supported on a pair of extruded support legs 58, however, other support constructions are also possible. In the embodiment shown in FIG. 16, the housing 18 is supported by a pair of casing supports 178 comprised of a suitable block, concrete or brick structure underneath each of the first and second end of the housing 18. For example, in FIG. 16, the casing support 178 comprises a vertical concrete support member 180. Preferably, the vertical concrete support member 180 is formed by pouring concrete into a plastic tube or sonotube, and wherein the vertical concrete support member 180 is supported by a suitable footing 182.

Figure 16:
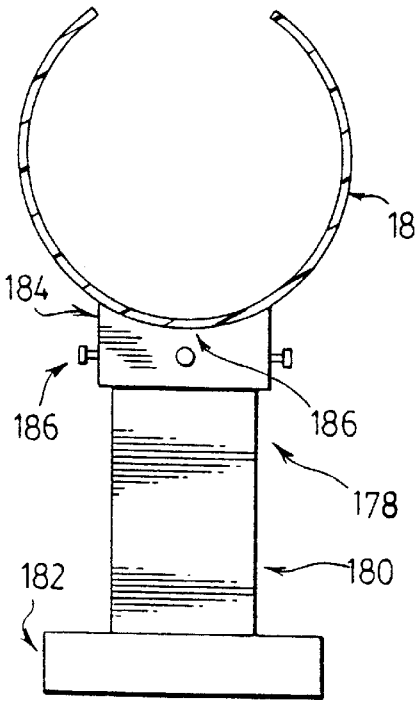
FIG. 16 is a perspective end view of the roller assembly housing illustrating a housing levelling bracket in accordance with a further embodiment of the invention.

Preferably, each casing support 178 furthermore has a casing leveller. In one embodiment, the casing leveller, as shown in FIG. 16, comprises a relatively short length of pipe 184 which is moveable up and down on the vertical concrete support member 180. The top portion 186 of the pipe 184 is shaped to receive the housing 18. The pipe 184 can be moved up and down on the vertical concrete support member 180 to adjust the height of the particular end of the housing 18. Adjustable screws 186 are tightened and forced into the vertical concrete support member 180 to fix the pipe 184 and the housing 18 at the desired height. Other support configurations are, however, possible.

The roller assembly 10 of the present invention lends itself to sale in kit form and its installation and assembly together with a solar blanket 8 at a swimming pool site is described best with reference to FIGS. 1 and 17 to 20.

Following or concurrently with the installation of the pool 6, a trench approximately 18 inches wide and 20 inches deep is formed parallel to the pool end 7 (FIG. 1), approximately 12 to 24 inches from the edge of the pool 6. The bottom of the trench is either lined with drainage tile 51 and/or a sufficient deep layer of crushed gravel 48 to provide an effective weeping bed to remove and accumulate water from within or around the roller assembly 10.

Figure 17:
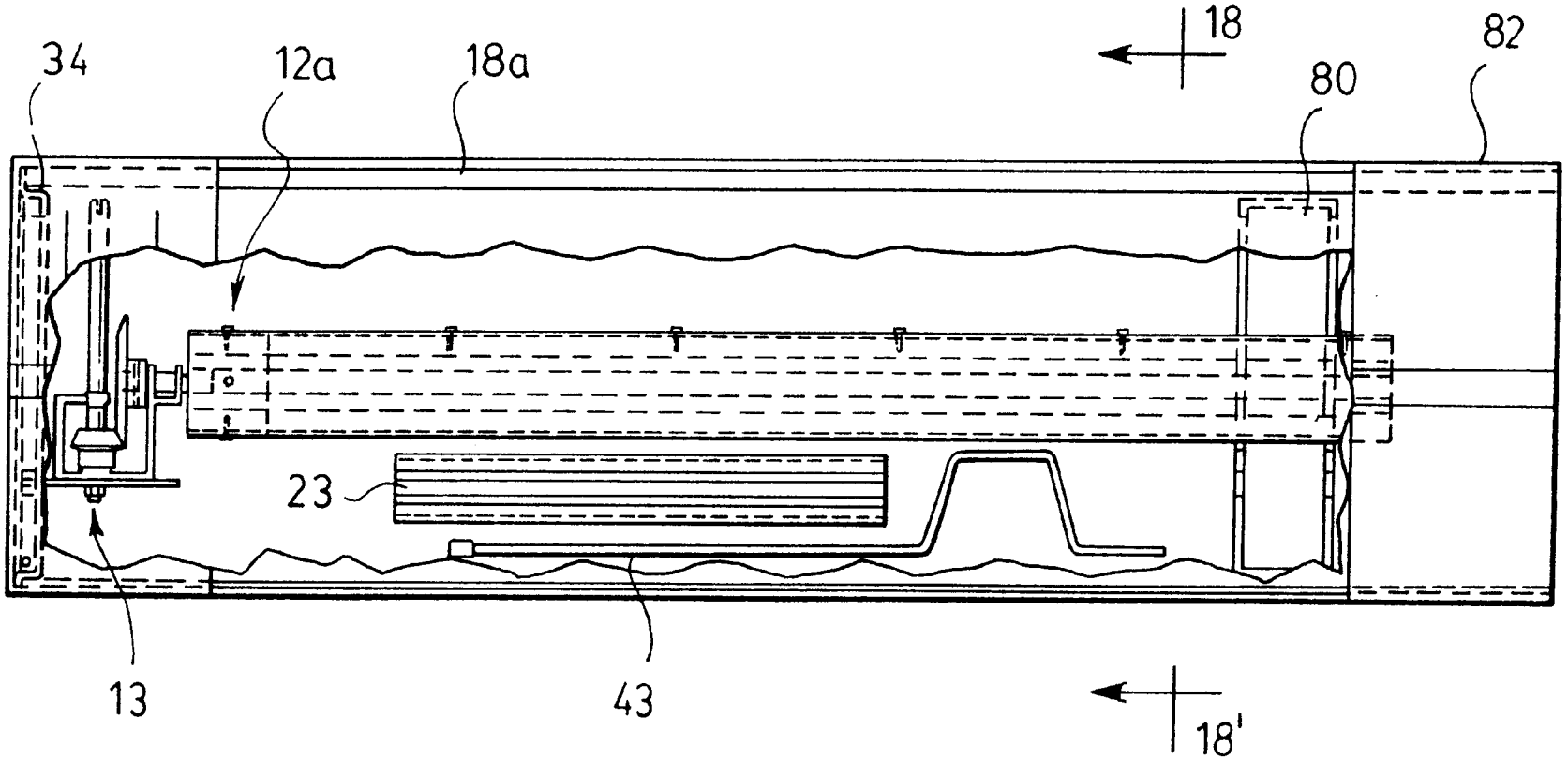
FIG. 17 is a schematic side view of a roller assembly and spindle housing sections prior to assembly and packaged as part of a kit.
Figure 19:
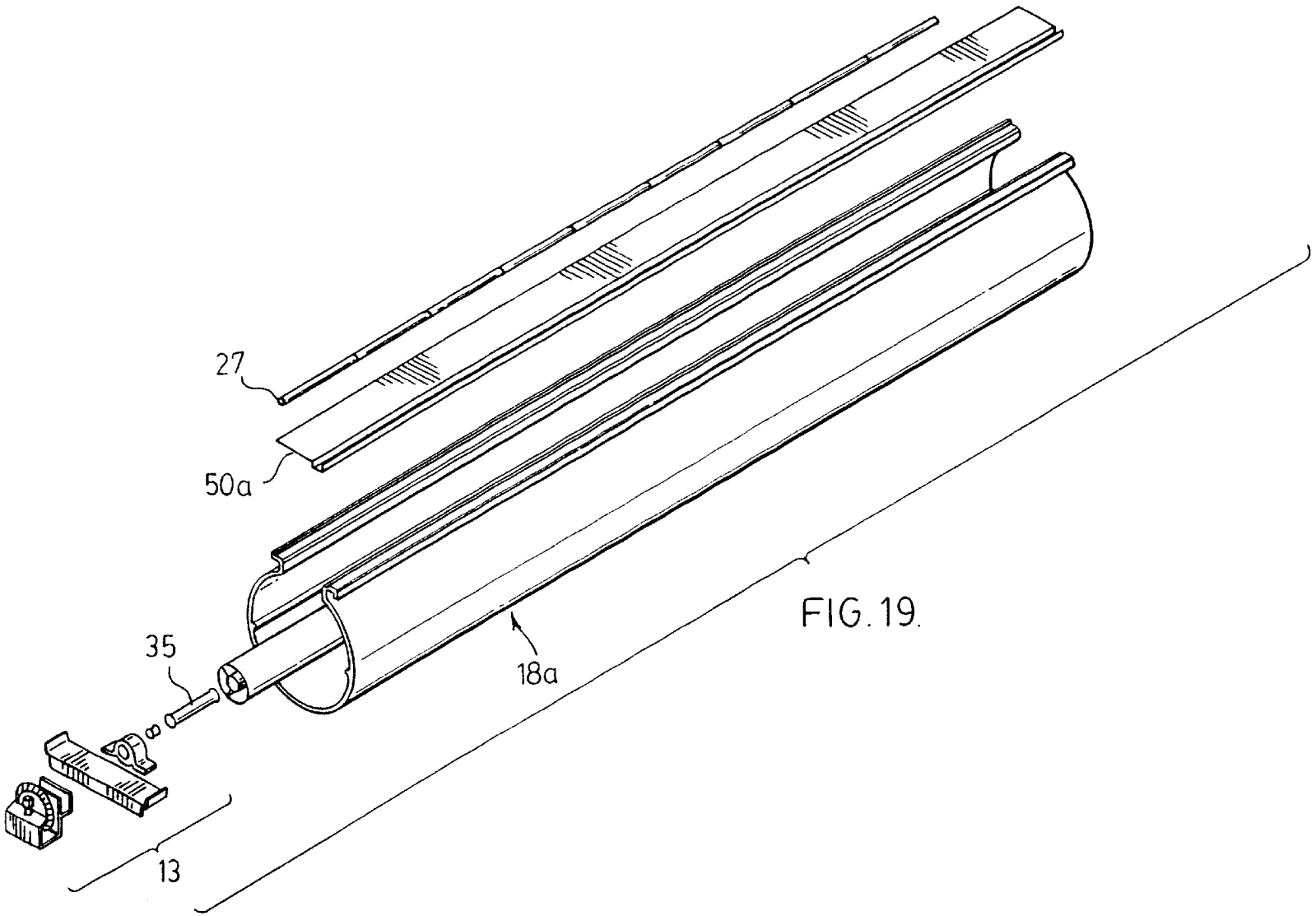
FIG. 19 is an exploded view of the roller assembly housing, lid, hinge and drive assembly.

Although not essential, in a preferred embodiment, the roller assembly 10 is shipped as a partially pre-assembled kit. In kit form, each of spindle sections 12*a* and 12*b* have their respective ends 14, 16 and the drive assembly 13 pre-mounted on their respective supports 26, 30 which have also been pre-attached to a respective housing section 18*a*, 18*b*. FIG. 17 shows the partially pre-assembled kit for the spindle section 12*a* as being pre-mounted within housing section 18*a*, and packaged within a cardboard box 82 for shipment. Within the box 82 are also packaged the connector 23 used to couple the spindle sections 12*a*, 12*b* together, the hand crank 43 and miscellaneous connecting hardware (not shown). As is shown, the end cap 34 has also been factory positioned over the end 20 of the housing section. Although not shown, it is to be appreciated that the remaining spindle section 12*b* and housing section 18*b* would be packaged in a like manner.

Figure 20A:
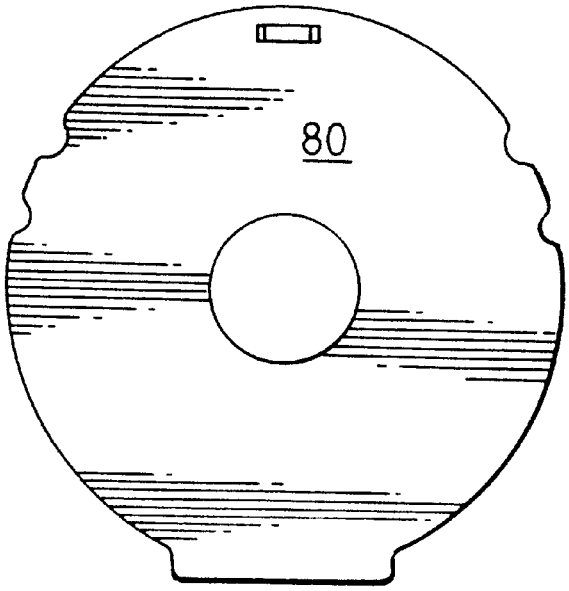
FIGS. 20*a* and 20*b* illustrate a side and end view of a cardboard insert used in the initial installation of the roller assembly housing.
Figure 20B:
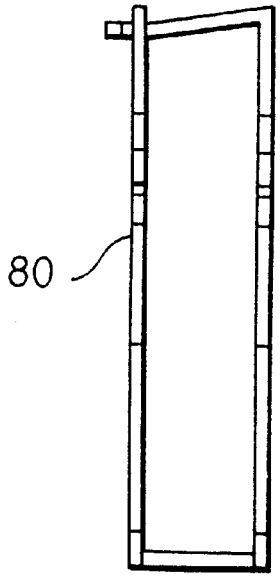

The free ends of the spindle sections 12*a*, 12*b* are held in place by a respective corrugated cardboard form 80 shown best in FIGS. 17 and 20*a* and 20*b*. The cardboard form has a profile which corresponds to the internal cross-section profile of the housing 18. The cardboard forms 80 maintain the proper alignment of the spindle sections 12*a*, 12*b* and provide additional lateral support to the housing 18 to offset any lateral pressure which occurs following the pouring of concrete 166 into place about the housing 18.

Initially, the individual housing sections 18*a*, 18*b* are unpacked from the box 82 and axially aligned with the open ends of each section 18*a*, 18*b* which are remote from the covered ends 20, 22 juxtaposed. The housing sections 18*a*, 18*b* are secured to each other by inserting fasteners through either welded or co-extruded loops 86 (FIG. 18) formed along the outer sides of the sections 18*a*, 18*b*. As shown best in FIG. 18, at the time of this extrusion, each section 18*a*, 18*b* extends continuously in the redial direction and further includes a planar PVC cut-out or knock-out portion or piece 88. The knock-out portion 88 is integrally formed with the extrusion and seals the opening 24 along its length. In addition to preventing debris and/or concrete from entering the housing 18 during installation, the use of a knock-out piece 88 and the formation of the housing 18 as a radially continuous extrusion, provides the housing sections 18*a*, 18*b* with increased structural integrity which resists deformation or distortion during installation.

Following the assembly of the housing 18, the aluminium lid 50 is next installed. The lid 50 may be a unitary construction, but more preferably consist of a number of individual sections having the identical cross-sectional profile, and which for ease of storage and shipping have an elongated length corresponding to that of the housing sections 18*a*, 18*b*. The sections of the lid 50 are assembled to the housing 18 by means of the hinges 27. Alternately, the lid sections could be pre-assembled to an individual housing section 18*a*, 18*b* prior to shipping of the roller assembly 10 to the end consumer. Simultaneously with the coupling of the housing 18, lid sections are joined together by inserting a spline (not shown) in a dovetail profile groove 89 (FIG. 2) extruded in the aluminium lid 50.

Following the assembly of the housing 18 and lid 50, the housing 18 is lowered into the trench with its lower positioning brackets 58 resting on the gravel bed 58. Once the housing 18 is so positioned, final adjustment is made to ensure that the upper flanges 25*a*, 25*b* are level with the deck surface 4, and the longitudinal axis of the housing 18 is aligned with the pool edge 7. Concrete 166 (or other suitable backfill material) is then poured as backfill about the housing 18, over the brackets 58 and under the flanges 25*a*, 25*b* to permanently secure the housing 18 in place.

Immediately following the pouring of the concrete 166, the lid 50 is opened and moved to a vertical orientation. It has been found that the movement of the lid 50 about the knuckle of the hinge 27 acts to straighten the PVC housing 18 and remove any twisting or bending. The PVC knock-out 88 is left in place until the concrete 166 has set both to maximize the rigidity of the housing 18 and to prevent concrete from entering the housing and otherwise fouling the spindle 12 or drive assembly 13.

Following the setting of the concrete 166, the knockout 88 is removed by either punching out, trimming with a knife or cutting with a circular or other power saw to thereby clear the opening 24. After the knock-out 88 is removed, the cardboard braces 80 are next removed from the housing interior. The spindle sections 12*a*, 12*b* are then joined by inserting the connector segment 23 in the open end of each spindle section 12*a*, 12*b* in the manner described.

Following the assembly of the spindle 12, the end 15 of a sheet of solar blanket material which is sized larger than that of the surface of the pool 6 is fastened to the spindle 12 by the clamping bar 19 (FIG. 8). With the end 15 of the blanket so secured, the spindle 12 is positioned in the desired rotatably mounted position within the housing 18 with the pivot shaft 35 at each of its ends 14,16 rotatably coupled to a respective end support 26, 30. The solar blanket form is then stretched across the pool 6 and is thereafter trimmed to exactly follow the contour of the pool surface 9. Following trimming, the solar blanket 8 and roller assembly 10 is thereafter ready for use.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein. For a definition of the invention, reference may be had to the appended claims.

I claim:

1. A solar blanket roller assembly for installation substantially below the deck of a pool, comprising:

a rotatable roller shaft for rolling and unrolling a solar blanket, the shaft having first and second ends and a longitudinal axis extending in a longitudinal direction;

a non-rotatable protective casing having first and second ends, the casing being elongated in the longitudinal direction and being spaced radially from said roller shaft, said casing further comprising, at least one extruded segment being elongated along an axis having a longitudinally extending knock-out portion in an upper region thereof which is removable to form part of an elongated opening, and a first end support for supporting and positioning the first shaft end inside the casing, a second end support for supporting and positioning said second shaft end inside the casing, and a drive spaced towards one end of said roller shaft and being selectively operable to rotate said roller shaft.

2. A roller assembly as defined in claim 1 wherein the casing further includes a second other elongated extruded segment having a longitudinally extending knock-out portion in an upper region thereof which is removable to form part of said elongated opening, and a connector for connecting the at least one extruded segment in juxtaposed axial alignment with the second other extruded segment.

3. A roller assembly as defined in claim 2 wherein the knock-out portion of each of the extruded segments are integrally formed therewith.

4. A roller assembly as claimed in claim 2 wherein said roller shaft comprises a first shaft section and a second shaft section, said first shaft section including said first shaft end, and said second shaft section including said second shaft end, said first shaft section being premounted in said at least one extruded segment with said first end support supporting said first shaft end therein, and the second shaft section being premounted in said second other extruded segment with said second end support supporting said second shaft end therein.

5. A roller assembly as claimed in claim 1 wherein said drive includes an electric motor selectively activatable to rotate said roller shaft.

6. A method of installing a below-deck solar blanket roller assembly for a swimming pool, the roller assembly comprising, a roller shaft for rolling and unrolling a solar blanket thereon, said roller shaft extending along a longitudinal axis from a first end to a second end, a non-rotatable protective casing having first and second end portions, the casing being elongated in the longitudinal direction and being spaced radially from said roller shaft, said casing further comprising, a first extruded segment and a second extruded segment, each of said first and second segments having a longitudinally extending knock-out portion in an upper region thereof which is removable to form part of an elongated opening, a first end support for supporting and positioning the first shaft end inside the casing, a second end support for supporting and positioning said second shaft end inside the casing, and a drive spaced towards one end of said roller shaft and being selectively operable to rotate said roller shaft, the roller assembly being installed by, coupling said first extruded segment to said second extruded segment with the knock-out portion of said first segment substantially aligned with said knock-out portion of said second segment, positioning said casing in a trench adjacent the pool with the knock-out portions oriented upwardly and substantially flush with a surface of the deck, backfilling about the casing, and removing said knock-out portions to form an elongated opening.

7. A method as claimed in claim 6 wherein said casing further includes a first end cover and a second end cover, each of the first extruded segment and the second extruded segment having substantially the identical cross-sectional profile and having respective first and second open ends, wherein prior to positioning said casing in said trench, securing said first end cover over said first open end of said first extruded segment, and securing said second end cover over said first end of said second extruded segment.

8. A method as claimed in claim 7 wherein said casing further includes a lid, and said method further comprises, hingely coupling said lid at a position adjacent to said first segment knock-out portion and said second segment knock-out portion, so as to be pivotally movable between first and second positions to substantially close or open said elongated opening; and said step of backfilling about said casing comprises pouring a settable concrete about said casing, and following said backfilling about the casing, moving said hinge from said first position to said second position.

9. A method as claimed in claim 6 wherein prior to the removal of said knock-out portions, each of said first extruded segment and said second extruded segment extend radially as a continuous extrusion.

10. A method as claimed in claim 6 wherein said roller shaft comprises a first shaft section and a second shaft section, said first shaft section including said first shaft end, and said second shaft section including said second shaft end, wherein prior to the coupling of the first extruded segment to the second extruded segment, said first shaft section is premounted in said first extruded segment with said first end support supporting said first shaft end therein, and the second shaft section is premounted in said second extruded segment with said second end support supporting said second shaft end therein.

11. A method as claimed in claim 6 wherein each of said first extruded segment and said second extruded segment includes a respective flange member adjacent to said knock-out portion and positioned so as to extend horizontally outwardly from said elongated opening following the positioning of the casing and removal of said knock-out portion, and wherein said step of backfilling comprises backfilling concrete about said casing substantially to said flanges.

12. A below-deck solar blanket roller assembly comprising:

a rotatable roller shaft for rolling and unrolling a solar blanket, the shaft having first and second ends and a longitudinal axis extending in a longitudinal direction;

a non-rotatable protective casing having first and second ends and extending in the longitudinal direction, the casing has a diameter selected such that the casing is spaced radially from the roller shaft, and wherein the casing has a knock-out portion removable to form an elongated opening extending in the longitudinal direction;

a first end support for supporting the first shaft end and positioning the first shaft end inside and relative to the casing;

a second end shaft support for supporting the second shaft end and positioning the second shaft end inside and relative to the casing;

a power coupler at an end of the roller shaft for receiving power from a source to rotate the roller shaft.

13. A roller assembly as claimed in claim 12 wherein said casing comprises a plurality of extruded plastic segments, each of said segments being joined in axial alignment.

14. A roller assembly as claimed in claim 13 wherein said roller shaft comprises a first shaft section and a second shaft section, said first shaft section including said first shaft end, and said second shaft section including said second shaft end, said first shaft section being premounted in a first extruded segment with said first end support supporting said first shaft end therein, and the second shaft section being premounted in a second other extruded segment with said second end support supporting said second shaft end therein.

15. A roller assembly as claimed in claim 14 wherein said drive includes an electric motor selectively activatable to rotate said roller shaft.

16. A roller assembly as defined in claim 12 further including a lid hingely coupled to said housing along a first longitudinal side portion of said knock-out portion.

17. A roller assembly as defined in claim 12 further comprising a lid which is moveable from a first position wherein the elongated opening in the casing is substantially covered by the lid to a second position wherein a portion of the lid is moved radially outward from the casing and the elongated opening in the casing is open, said lid including a first cover portion hingely connected to a first one of said extruded segments, a second cover portion hingely connected to a second other one of said extruded segments; and a connector for connecting said first cover portion to said second cover portion.

18. A roller assembly as defined in claim 17 wherein the opening in the casing is defined by first and second edges, and wherein the lid is hinged to the casing in an area adjacent to the first edge.

19. A roller assembly as defined in claim 12 wherein the casing is formed from extruded PVC.

20. A roller assembly as defined in claim 12 wherein a first end cover sealingly closes the first end of the casing and a second end cover sealingly closes the second end of the casing.

* * * * *